US006472993B1

(12) United States Patent
Addy

(10) Patent No.: US 6,472,993 B1
(45) Date of Patent: Oct. 29, 2002

(54) SINGULAR HOUSING WINDOW OR DOOR INTRUSION DETECTOR USING EARTH MAGNETIC FIELD SENSOR

(75) Inventor: Kenneth L. Addy, Massapequa, NY (US)

(73) Assignee: Pittway Corp., Chicago, IL (US)

( * ) Notice: Subject to any disclaimer, the term of this patent is extended or adjusted under 35 U.S.C. 154(b) by 0 days.

(21) Appl. No.: 09/982,357

(22) Filed: Oct. 16, 2001

(51) Int. Cl.[7] ..... G08B 21/00

(52) U.S. Cl. ..... 340/686.1; 340/545.1; 340/545.6; 340/545.9; 340/547; 340/539; 340/693.9; 340/568.1; 340/571; 340/689

(58) Field of Search ..... 340/686.1, 545.1, 340/545.6, 545.9, 547, 539, 693.9, 568.1, 571, 689

(56) References Cited

U.S. PATENT DOCUMENTS

| | | | | |
|---|---|---|---|---|
| 3,573,817 A | * | 4/1971 | Akers | 340/420 |
| 3,725,890 A | | 4/1973 | Cirino | 340/262 |
| 3,745,553 A | * | 7/1973 | Kardashian | 340/276 |
| 3,786,674 A | | 1/1974 | Skujins, Jr. | 73/71.4 |
| 3,962,693 A | | 6/1976 | Schamblin | 340/261 |
| 4,057,791 A | | 11/1977 | Bimmerle et al. | 340/261 |
| 4,207,770 A | | 6/1980 | Grushow | 73/517 R |
| 4,333,029 A | | 6/1982 | Kolm et al. | 310/329 |
| 4,361,740 A | | 11/1982 | Stockdale | 200/61.45 R |
| 4,424,631 A | | 1/1984 | Franks | 33/361 |
| 4,546,551 A | | 10/1985 | Franks | 33/356 |
| 4,681,991 A | | 7/1987 | Anderson | 200/61.45 R |
| 4,845,464 A | | 7/1989 | Drori et al. | 340/429 |
| 5,258,743 A | | 11/1993 | Nelson et al. | 340/568 |
| 5,534,849 A | * | 7/1996 | McDonald et al. | 340/517 |
| 5,559,358 A | | 9/1996 | Burns et al. | 257/431 |
| 5,654,686 A | | 8/1997 | Geschke et al. | 340/426 |
| 5,807,111 A | | 9/1998 | Schrader | 434/112 |
| 5,915,278 A | | 6/1999 | Mallick | 73/658 |
| 6,249,225 B1 | * | 6/2001 | Wang | 340/545.9 |
| 6,310,549 B1 | * | 10/2001 | Loftin et al. | 340/547 |

OTHER PUBLICATIONS

White, Tim; "A New Sensor ASIC for Changing Magnetic Fields," www.sensormag.com, Mar. 2000, pp. 46–50.
Vector Compass Application Notes.

* cited by examiner

*Primary Examiner*—Daniel J. Wu
*Assistant Examiner*—Tai T. Nguyen
(74) *Attorney, Agent, or Firm*—Anthony R. Barkume

(57) ABSTRACT

The present invention is a method, an apparatus, and a system for detecting a change in position of a door or a window in an alarm system. The present invention is a singular housing with a magnetometer for monitoring the magnetic field of the earth, and a microprocessor for detecting a change in the position of the singular housing with respect to the magnetic field of the earth. The microprocessor generates an alarm signal upon detecting the change, and causes the alarm signal to be transmitted, by wireless transmission, to a remote receiving station.

19 Claims, 3 Drawing Sheets

SINGULAR HOUSING WINDOW OR DOOR INTRUSION DETECTOR USING EARTH MAGNETIC FIELD SENSOR

BACKGROUND OF THE INVENTION

This invention relates to window or door intrusion sensors for security systems, and in particular to a wireless sensor, contained in a singular housing, that detects a change in the position of a door or window to which the sensor is attached by detecting a change in the magnetic field created by the earth.

Conventional door or window sensors in security systems contain two housings; one housing with a magnet, and one housing with a sensor such as a reed switch, which is a miniature encapsulated switch that is activated by a magnetic field. One of the housings is mounted to the door or window (entrance closure) being monitored and the other housing is mounted to the doorjamb or windowsill associated with the entrance closure being monitored. When the entrance closure is closed and the magnet is in close proximity to the reed switch sensor, the sensor produces an output signal that indicates that the door is in its closed position. Once the entrance closure is moved the magnet is not in close proximity to the reed switch sensor and the sensor produces an output signal that indicates the door is not in its closed position. The output signal is periodically read by the alarm system controller, and when the signal indicates that the door is not in its closed position, the alarm system controller activates an alarm condition. The alarm system controller may receive this information through wired or wireless transmission. Alarm systems of this type are described in U.S. Pat. Nos. 4,677,424; 4,339,747; 3,896,427; 3,668,579; 4,359,719; and 4,241,337.

Alarm systems using reed switch sensors, as described above, are reasonably successful in many applications, although there are a number of drawbacks as follows:

1) There is additional cost and time, during installation, for the installer to mount a second device (i.e. the magnet).

2) The position of the magnet in conjunction with the sensor is often critical and the installer spends time shimming and locating the magnet to optimize the reed to magnet gap.

3) Reed switches, which are glass encapsulated switches are fragile and may be damaged at the time of installation.

4) Sensors with two housings can be defeated during the period when the system is in the disarmed state by the addition of an extra magnet taped to the sensor housing. This maintains the reed in its closed position even if the door is opened during an armed state.

It is therefore an object of the design to deliver improved security to the system, since any attempt to tamper with the device by adding a magnet would cause an alarm condition.

It is therefore an object of the present invention to provide an entrance closure sensor that is contained in a single housing.

It is a further object of the present invention to provide an entrance closure sensor with improved sensor reliability.

SUMMARY OF THE INVENTION

In accordance with these and other objects, the present invention is a method, an apparatus, and a system for detecting a change in position of an entrance closure in an alarm system, wherein the entrance closure is either a door or a window.

The method comprises the steps of attaching a singular housing on an entrance closure; monitoring, with apparatus in the housing, the magnetic field of the earth, detecting a change in the position of the housing with respect to the magnetic field of the earth, generating an alarm signal upon detecting a change in position of the housing with respect to the magnetic field of the earth that exceeds a first predetermined threshold, and transmitting by wireless transmission the alarm signal to a remote receiving station.

The apparatus comprises a singular housing with means for monitoring the magnetic field of the earth, means for detecting a change in the position of the housing with respect to the magnetic field of the earth, means for generating an alarm signal upon detecting a change in position of the housing with respect to the magnetic field of the earth, and means for transmitting by wireless transmission the alarm signal to a remote receiving station. The alarm signal may contain a programmable unique transmitter identification number that allows the receiving station to decipher which sensor has sent the alarm message. The monitoring of the magnetic field of the earth is performed by a magnetometer that senses the earth's magnetic field and generates an output signal correlated to the earth's magnetic field. A microprocessor detects a change in the position of the housing by sampling the magnetometer's output signal at predetermined intervals and determining if the sampled output is different from a stored static (initial) output. If the sampled output is different from the stored static output by a first predetermined amount the microprocessor generates an alarm signal and causes the alarm signal to be transmitted. In addition, if the sampled output is different from the stored static output by a second predetermined amount, the microprocessor generates a trouble signal, wherein the second predetermined amount is less than the first predetermined amount. This may occur when the door or window is slightly ajar. This feature is useful to a user during arming of the alarm system, wherein the user can ensure the entrance enclosures are closed prior to vacating the premises being monitored.

The alarm system comprises the apparatus described above for detecting a change in position of an entrance closure, and a receiving station, located remotely from the apparatus. The receiving station comprises means for receiving by wireless transmission the alarm signal from the apparatus, and means for indicating an alarm condition in response to the receipt of the alarm signal.

The step of detecting a change in the position of the housing with respect to the magnetic field of the earth may take place on three axes and the generation of an alarm signal may occur upon detecting a change in position of the housing in two of the three axes.

In order to provide security with less false alarms, the remote receiving station may correlate the alarm signal from the apparatus of the present invention with a second alarm signal from a different sensor, which may be a motion sensor.

DETAILED DESCRIPTION OF THE PREFERRED EMBODIMENT

Figure 1:
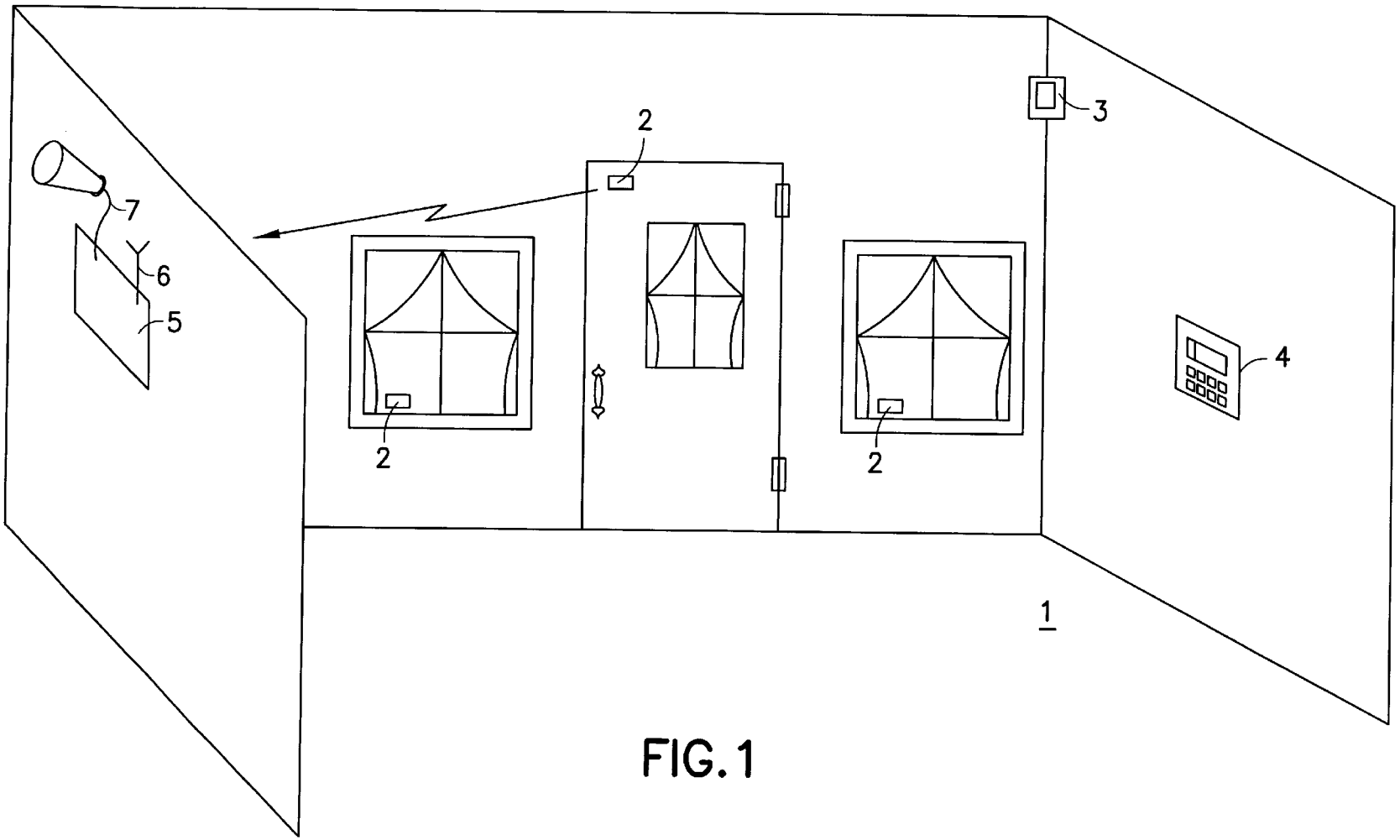
FIG. 1 is a diagram of an alarm system with singular housing sensors.

FIG. 1 shows an area monitored by an alarm system 1. The alarm system 1 comprises three singular housing sensors 2, on three entrance closures—a door and two windows; a motion detector 3; a keypad 4; a control 5 (in a remote location); a wireless receiver 6; and a siren 7. The detection of an intruder by an alarm system 1, as well known in the art, is as follows: a user arms the alarm system 1 using the keypad 4. The keypad 4 sends an arm message to the control 5. The sensors 2 and 3 monitor a change in conditions, i.e. if the door or windows are open or if motion has been detected. If there is a change in conditions, the sensors 2 and/or 3 send an alarm message to the wireless receiver 6 that causes the control 5 to sound the siren 7. Alternatively, the alarm system 1 may correlate alarm messages from a singular housing sensor 2 and the motion detector 3 before sounding the siren 7.

The detection of an intruder by an alarm system 1 that uses singular housing sensors 2 is the same as alarm systems of the prior art. The difference between the present invention alarm system 1 and the prior art alarm systems is that the door and window sensors of the prior art contain two housings, one housing with a magnet located on the door or window and one housing with a switch located on the doorjamb or windowsill (or vice versa). In the prior art, when the door or window is opened, the magnet moves away from the switch causing the switch to change positions. The change in the switch position causes an alarm message to be transmitted to the receiver 6. In the present invention, the singular housing sensor 2 has only one housing located on the window or door being monitored.

Figure 2:
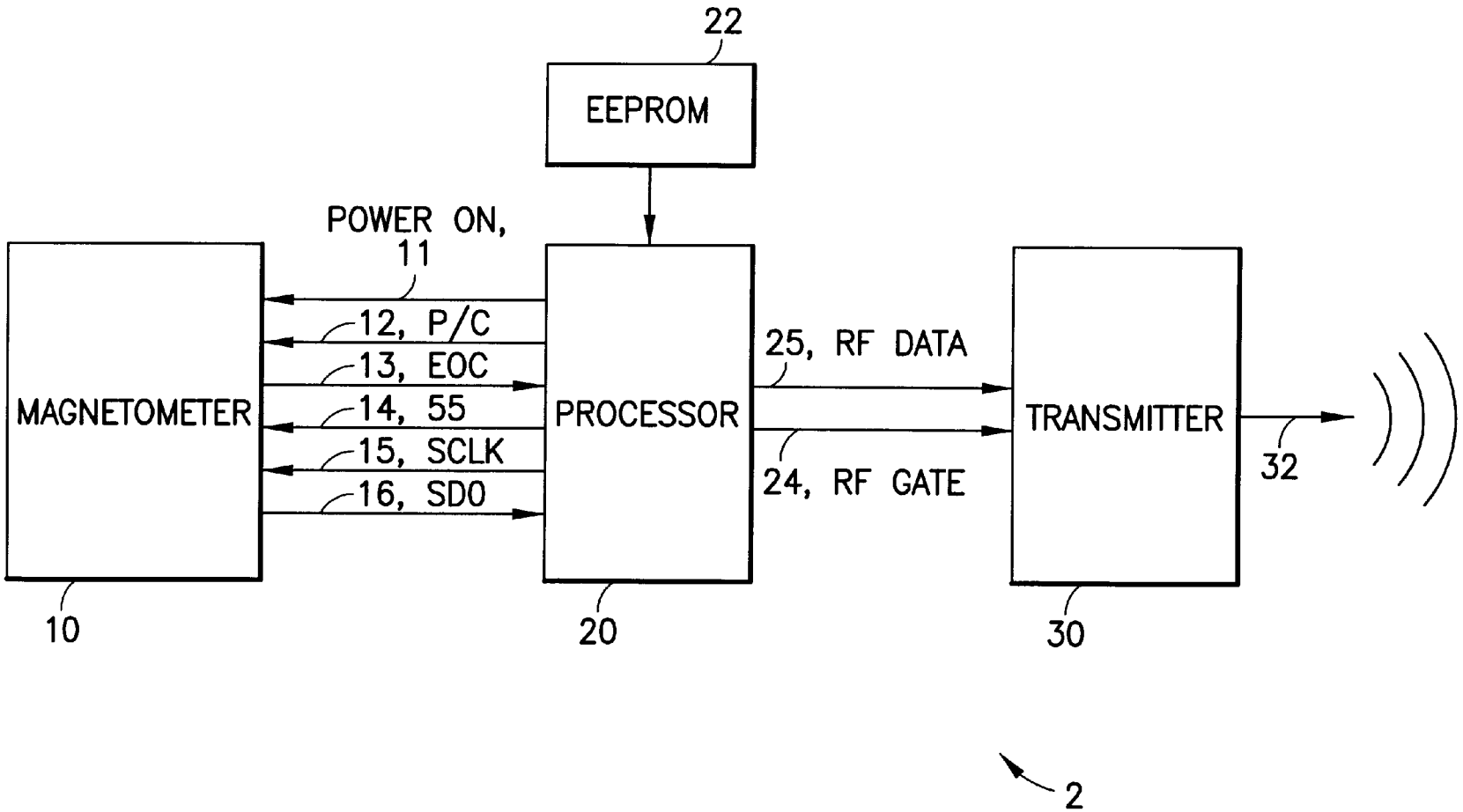
FIG. 2 is a block diagram of a singular housing sensor.

As shown in FIG. 2, the singular housing sensor 2 contains a magnetometer 10, a processor 20 and a transmitter 30. When the door or window is moved, the magnetometer 10 senses a change in the earth's magnetic field. The processor 20 determines when the magnetometer's 10 output has changed and initiates the transmitter 30 to transmit an alarm message to the receiver 6.

The magnetometer 10 (for example, a commercially available model from Precision Navigation) senses a change in the earth's magnetic field in the following manner: an accurate reference signal with a 4 MHz frequency, produced by a crystal oscillator, is compared to the natural frequency of three inductance/resistance (LR) circuits one at a time. Each circuit is oriented orthogonally in the singular housing so as to sense X, Y, and Z directions. The natural frequency of the LR circuit is affected by the magnetic flux through the LR circuit, essentially it is a flux to frequency converter. The magnetic flux, and therefore the frequency of the resultant signal, is not only dependent on the value of the inductance and resistance components, but also on the relative position of the LR circuit to the earth's magnetic field. Therefore, a change in the position of the magnetometer 10 produces a resultant signal with a different frequency. The magnetometer 10 also comprises a state machine that drives the current through each of the sensor's LR circuits, such that they are biased in both directions, first measuring the frequency in a certain polarity with an up-counter, then driving the signal through the LR circuits in the reverse polarity, measuring frequency with the counter switched so as to count down. The final count is an indication of the magnetic field direction and strength relative to the reference signal, and it is proportional to magnetic flux at that location. The final count for each direction is a signed 16 bit word which is stored for transmission to the processor 20.

The interface between the magnetometer 10 and the processor 20 in the present invention will now be described. The processor 20 provides power to the magnetometer 10 using Power On signal 11. This allows the processor 20 to conserve power by only turning the magnetometer 10 on when the processor 20 will be collecting data. Once the power is on, the processor pulls the P/C signal 12 low for at least 10 msec. A low level on the P/C signal 12 causes the magnetometer 10 to pull the EOC signal 13 low and to start its calculations as described above. The magnetometer 10 causes the EOC signal 13 to go high again when the data is ready to be retrieved (about 100 msec). In order for the processor 20 to read the data, the processor 20 must pull SS signal 14 low and provide 48 clock cycles on SCLK signal 15. On each of the rising edges of the SCLK signal 15, the magnetometer 10 will provide one bit of the 48-bit data word onto SDO signal 16. The 48-bit data word contains three signed 16-bit integers.

The first is from the X-axis, the second is from the Y-axis, and the third is from the Z-axis. Once the complete data word is read by the processor 20, it pulls the SS signal 14 high and discontinues the Power On signal 11. The processor 20 next processes the data and determines if an alarm condition exists, as described below. If an alarm condition does exist, the processor 20 generates an alarm message containing the unique transmitter identification number programmed in EEPROM 22, enables the transmitter 30 with RF gate signal 24, and sends the alarm message to the transmitter 30 on RF data signal 25. The transmitter 30 then transmits the alarm message from antenna 32 to the receiver 6.

Figure 3:
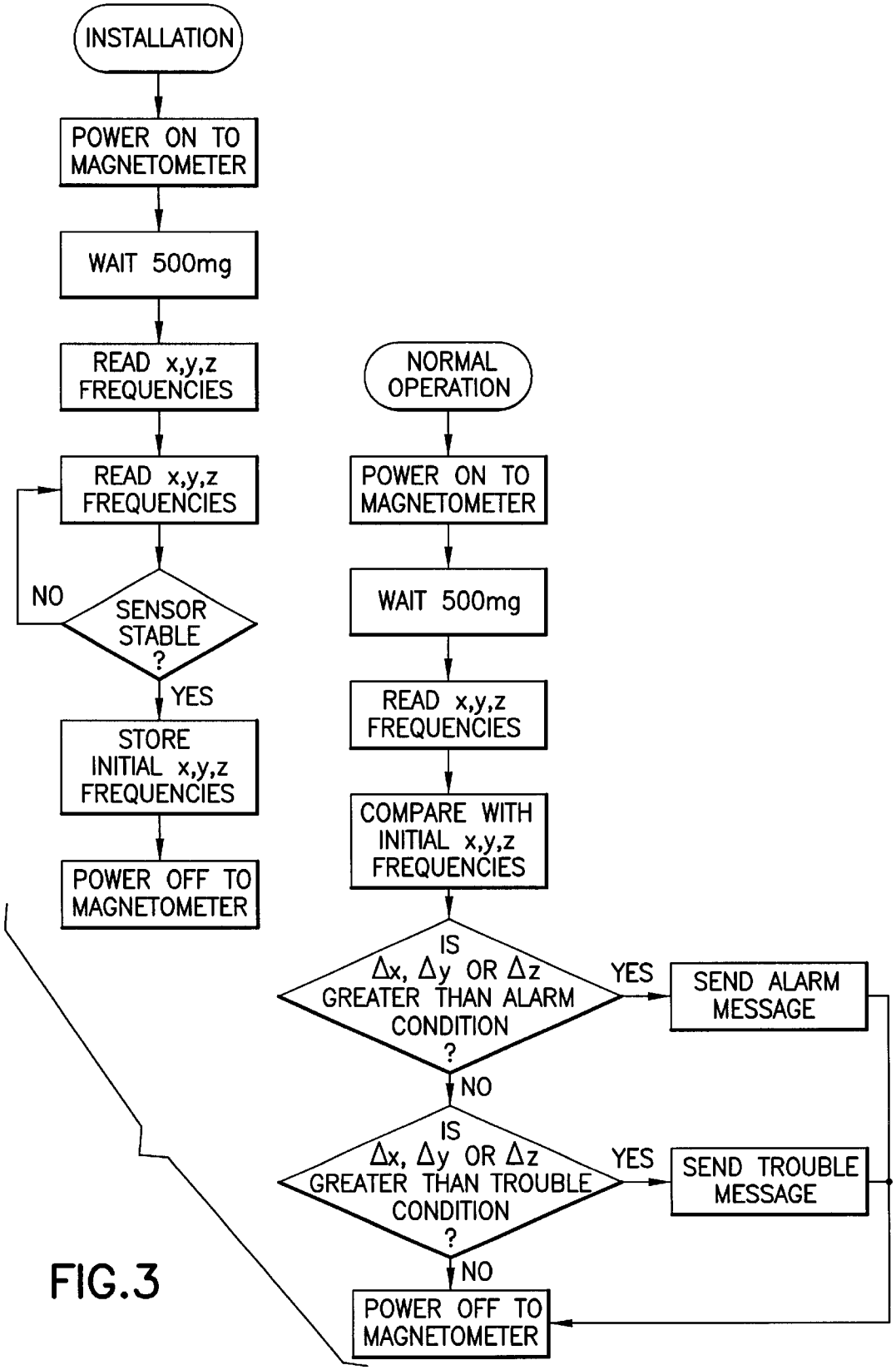
FIG. 3 is flow chart of the operation of a singular housing sensor.

Shown in FIG. 3 is a flow chart for the processing of the data from the magnetometer 10 by the processor 20. During installation of the alarm system, the processor 20 performs a set up mode, where it determines the initial coil frequencies from the magnetometer 10. In this mode, the processor 20 enables power to the magnetometer 10 and waits 500 msecs before reading the data from the magnetometer 10, as described above. The processor 20 reads the data again and possibly a number of times until the data is stable, i.e. the coil frequency is the same for each reading. Once the data is stable, the processor stores the X, y, and z coil frequencies and turns the power off. After the set up mode is completed, the processor 20 turns power on to the magnetometer 10 at a periodic interval, sampling the X, Y, and Z coil frequencies each time, comparing them to the stored initial coil frequencies and determining if the difference is greater than an alarm threshold and if not than a trouble threshold. If the difference is greater than the alarm threshold, the processor causes an alarm message to be transmitted from the transmitter 30. If the difference is not greater than the alarm message, but is greater than the trouble threshold, a trouble message is transmitted. The trouble threshold is smaller than the alarm threshold and indicates that the door is slightly ajar. This is useful during arming of the alarm system. If the difference is not greater than either threshold the processor 10 removes power from the magnetometer 10.

It will be apparent to those skilled in the art that modifications to the specific embodiments described herein may be made while still being within the spirit and scope of the present invention. For example, the alarm message or trouble message may be transmitted when the difference between the initial x, y, and z coil frequencies and the sampled x, y, and z coil frequencies is above a predetermined threshold for two out of the three samples, or may be the predetermined threshold is different for each of the x, y, and z axes.

I claim:

1. A method of detecting a change in position of an entrance closure in an alarm system comprising the steps of:

a) attaching a singular housing on the entrance closure that is being monitored;

b) monitoring, with apparatus in the housing, the magnetic field of the earth;

c) detecting, with apparatus in the housing, a change in the position of the housing with respect to the magnetic field of the earth;

d) generating an alarm signal upon detecting a change in position of the housing with respect to the magnetic field of the earth that exceeds a first predetermined threshold;

e) transmitting by wireless transmission the alarm signal to a remote receiving station; and f) generating a trouble signal upon detecting a change in position of the housing with respect to the magnetic field of the earth that exceeds a second predetermined threshold.

2. The method of claim 1 wherein the entrance enclosure is a door.

3. The method of claim 1 wherein the entrance enclosure is a window.

4. The method of claim 1 wherein said apparatus in the housing comprises:

a) a magnetometer that detects the earth's magnetic field and generates an output signal, wherein the output signal is correlated to the earth's magnetic field;

b) a microprocessor for detecting a change in the output signal from the magnetometer, and for generating an alarm signal when the change is greater than the first predetermined threshold; and c) an RF transmitter for transmitting the alarm signal.

5. The method of claim 4 wherein said monitoring step comprises the steps of:

a) determining a static output signal from the magnetometer;

b) storing the static output signal from the magnetometer; and c) sampling the output signal from the magnetometer at a predetermined time interval.

6. The method of claim 4 wherein said detecting step comprises the steps of:

a) subtracting the sampled output from the magnetometer from the stored static output of the magnetometer to produce a difference value; and b) determining if the absolute value of the difference value is greater than the first predetermined value.

7. The method of claim 1 wherein said step of detecting a change in the position of the housing with respect to the magnetic field of the earth takes place on three axis.

8. The method of claim 7 wherein said step of generating an alarm signal occurs upon detecting a change in position of the housing in two of the three axes.

9. The method of claim 1 wherein the remote receiving station correlates the alarm signal with a second alarm signal from a second sensor.

10. The method of claim 1 wherein the second predetermined threshold is less than the first predetermined threshold.

11. An apparatus for detecting a change in position of an entrance closure in an alarm system comprising:

a singular housing attached to an entrance closure being monitored; the housing comprising:

a) means for monitoring the magnetic field of the earth;

b) means for detecting a change in the position of the housing with respect to the magnetic field of the earth;

c) means for generating an alarm signal upon detecting a change in position of the housing with respect to the magnetic field of the earth that exceeds a first predetermined threshold;

d) means for transmitting by wireless transmission the alarm signal to a remote receiving station; and e) means for generating a trouble signal upon detecting a change in position of the housing with respect to the magnetic field of the earth that exceeds a second predetermined threshold.

12. The apparatus of claim 11 wherein the entrance enclosure is a door.

13. The apparatus of claim 11, wherein the entrance enclosure is a window.

14. The apparatus of claim 11 wherein said means for monitoring comprises:

a) a magnetometer that detects the earth's magnetic field and generates an output signal, wherein the output signal is correlated to the earth's magnetic field; and b) a microprocessor for sampling the output signal and evaluating it.

15. The apparatus of claim 11 wherein said apparatus for detecting a change in the position of the housing with respect to the magnetic field of the earth takes place on three axes.

16. The apparatus of claim 15 wherein said means for generating an alarm signal generates an alarm signal upon the detection of a change in position of the housing in two of the three axes.

17. The apparatus of claim 11 wherein the remote receiving station correlates the alarm signal with a second alarm signal from a second sensor.

18. The apparatus of claim 11 wherein the alarm signal contains a unique transmitter identification number.

19. An alarm system comprising:

a) an apparatus for detecting a change in position of an entrance closure comprising:

i. a singular housing attached to the entrance closure being monitored; the housing comprising:

1. means for monitoring the magnetic field of the earth;
2. means for detecting a change in the position of the housing with respect to the magnetic field of the earth;
3. means for generating an alarm signal upon detecting a change in position of the housing with respect to the magnetic field of the earth that exceeds a first predetermined threshold;
4. means for transmitting by wireless transmission the alarm signal to a remote receiving station; and
5. means for generating a trouble signal upon detecting a change in position of the housing with respect to the magnetic field of the earth that exceeds a second predetermined threshold; and b) a receiving station located remotely from the housing comprising i. means for receiving by wireless transmission the alarm signal from the housing, and ii. means for indicating an alarm condition in response to receipt of the receipt of the alarm signal.

* * * * *